US006372092B1

(12) United States Patent
Bubik et al.

(10) Patent No.: US 6,372,092 B1
(45) Date of Patent: Apr. 16, 2002

(54) HEADBOX AND PROCESS FOR SUPPLYING A MATERIAL SUSPENSION

(75) Inventors: Alfred Bubik; Joachim Henssler, both of Ravensburg; Jürgen Prössl, Horgenzell; Karl Müller, Baindt; Walter Holzer, Hofstetten; Mathias Schwaner, Ravensburg, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/478,219

(22) Filed: Jan. 5, 2000

(30) Foreign Application Priority Data

Jan. 23, 1999 (DE) ..... 199 02 623

(51) Int. Cl.[7] ..... D21F 1/02

(52) U.S. Cl. ..... 162/344; 162/343; 162/216; 162/336

(58) Field of Search ..... 162/343, 344, 162/336, 212, 216

(56) References Cited

U.S. PATENT DOCUMENTS

| | | | | |
|---|---|---|---|---|
| 3,038,538 A | | 6/1962 | Logan et al. | |
| 3,878,039 A | * | 4/1975 | Descary | 162/343 |
| 3,937,273 A | | 2/1976 | Radvan et al. | |
| 4,604,164 A | * | 8/1986 | Fujiwara et al. | 162/343 |
| 4,765,868 A | * | 8/1988 | Fujiwara | 162/343 |
| 4,971,659 A | | 11/1990 | Takeuchi | |
| 5,599,428 A | | 2/1997 | Meinecke et al. | |
| 5,603,807 A | * | 2/1997 | Heinzmann | 162/336 |
| 5,622,603 A | * | 4/1997 | Begemann et al. | 162/343 |
| 5,804,037 A | | 9/1998 | Meinecke et al. | |

FOREIGN PATENT DOCUMENTS

| | | |
|---|---|---|
| CA | 2036446 | 8/1991 |
| DE | 4005147 | 8/1991 |

* cited by examiner

*Primary Examiner*—Karen M. Hastings
(74) *Attorney, Agent, or Firm*—Greenblum & Bernstein, P.L.C.

(57) ABSTRACT

Headbox of a paper machine and a process of supplying a material suspension, The headbox includes at least one material suspension supplying system, and a headbox nozzle that includes a first dividing wall having a machine width and a second dividing wall having a machine width. The first and second dividing walls are arranged to form a first path in which a total nozzle cross-section steadily and continually decreases in a material flow direction and to form a second path, arranged to follow the first path, in which a total nozzle cross-section continually increases in the material flow direction. The process includes includes accelerating the material suspension along a first path having a total nozzle cross-section that steadily and continually decreases in a material flow direction, and decelerating the material suspension along a second path having a total nozzle cross-section that continually increases in the material flow direction. The second path is arranged to follow the first path.

38 Claims, 3 Drawing Sheets

HEADBOX AND PROCESS FOR SUPPLYING A MATERIAL SUSPENSION

CROSS-REFERENCE TO RELATED APPLICATIONS

The present application claims priority under 35 U.S.,C. §119 of German Patent Application No. 199 02 623.8, filed on Jan. 23, 1999, the disclosure of which is expressly incorporated by reference herein in its entirety.

BACKGROUND OF THE INVENTION

1. Field of the Invention

The present invention relates to a headbox of a paper machine having at least one material suspension supplying system, at least one subsequent region for producing turbulence, and one headbox nozzle having one first and one second dividing wall running the width of the machine. The headbox nozzle has a first path in which the total cross-section of the headbox nozzle, i.e., total free cross-sectional surface flowed through by suspension, steadily and continuously decreases such that a second, shorter path immediately follows the first path.

2. Discussion of Background Information

A headbox similar in general to the above-noted headbox is disclosed in commonly assigned U.S. Pat. No. 5,599,428. In this patent, different variations of multi-layer headboxes, which are provided with differently constructed or formed separating lamellas, are disclosed.

Paper manufactured using headboxes of the above-noted type has the problem of insufficient crosswise stiffness $SCT_{cross}$, which can cause disruptions in operation when used, e.g., in modem copying systems or in printers with automatic paper feed. Further, it would be advantageous for a breaking length ratio L/Q, where L is lengthwise in a machine direction and Q is crosswise to the machine direction, after sheet formation to be reduced to a range of between approximately 0,6 and 1.0, if possible.

SUMMARY OF THE INVENTION

The present invention provides a headbox that improves the crosswise stiffness of manufactured paper in which breaking length ration L/Q can be reduced, if possible.

The inventors of the instant invention recognize that the crosswise stiffness of the paper improves substantially if care is taken, by appropriately shaping the headbox nozzles, especially in the end region, to ensure that the fibers in the material suspension in the end region of the nozzle are turned more strongly in the z direction lying parallel to the sheet surface and, if possible, stretched as well.

Accordingly, the instant invention is directed to headbox of a paper machine with at least one material suspension supplying system, at least one following region for producing turbulence, and one headbox nozzle with one first and one second dividing wall running the width of the machine. The headbox nozzle has a first path in which a total cross-section of the headbox nozzle, i.e., the total free cross-sectional surface flowed through by the suspension in the respective machine section, steadily and continually decreases, and a second, shorter path immediately following the first path. Further, the second path has a continually widening total cross-section that extends toward an end of the headbox nozzle, which causes a flow deceleration in the end region of the headbox nozzle so that no substantial turbulence arises. The speed profile hereby caused stretches fibers in the suspension in the z direction and improves the crosswise stiffness of the finished paper. An additional positive side effect of this influence on the suspension is that the breaking length ratio L/Q decreases and can take on values between approximately 0.6 and 1.0.

According to an exemplary embodiment of the invention, an additional third path, which directly follows the second path, can be positioned to extend to the end of the headbox nozzle. In this manner, the second path has a continually widening total cross-section and the third path can have a steadily and constantly decreasing total cross-section. It may be advantageous for the length of the third path to be shorter than the length of the second path, and for the length of the second path to be shorter than the length of the first path. By selecting the corresponding ratios of the path length, it is possible to increase or decrease the crosswise stiffness stimulating effect. As such, the length of the third path should remain shorter than the length of the second path. This length ratio prevents the fiber orientation achieved in the second path from being overcompensated in the third path.

The first path can be positioned to begin immediately downstream of the turbulence producing region. Further, the total cross-section of the headbox nozzle can be formed, at least across one part of the headbox nozzle, by only one suspension conduit. In this way, no separation elements for separating individual levels are present in this region. This arrangement can reduce edge effects, and the height of the flow cross-section available at one unit can correspond to the total cross-section, so that a better fiber orientation in the z direction can be achieved.

For example, when the headbox is employed as a multiple layer headbox, it can be advantageous for the total cross-section of the headbox nozzle to include several suspension conduits, at least over a part of the headbox nozzle length, which are formed, e.g., by at least one separating element that extends across width of the machine and that is arranged between the first and second dividing walls. Moreover, it can be particularly advantageous for all suspension conduits to have the same cross-section progression without exception so that the same acceleration and deceleration ratios are provided for the suspension flowing through each conduit. It may also be advantageous for all suspension conduits without exception to have a congruent form, and be symmetrically congruent. Not only does this allow even progression of the acceleration and deceleration in the suspension conduits, but it also allows the vector field in each suspension conduit to be identical along the entire length.

In another exemplary embodiment, the degree of divergence in the region of the second path can be the same for all suspension conduits.

For example, when utilizing internal separating elements, the divergence of the individual suspension conduits can be achieved in that the separating elements in the region of the second path are arranged to have a taper. Here, it can be advantageous for the degree of convergence of the surfaces of the tapering ends of all separating elements to be the same so as to achieve as unified a flow ratio as possible across the cross-section of the headbox.

It may be further advantageous for the progression of the upper wall and/or lower wall, at least in the second region, to be constructed or formed symmetrically to the progression of the surface of the neighboring separation element. In this manner, the outermost suspension conduits can be constructed as identically to the innermost suspension conduits as possible.

Further, the headbox according to the present invention includes a turbulence producer with a plurality of diffusion tubes in which the diffusion tubes are arranged in rows running across the width of the machine and the separating elements are arranged to begin between the rows of diffusion tubes.

In a headbox provided for a gap former, the upper and lower walls of the headbox can be and, preferably should be, made equal in length.

In accordance with features of the instant invention, it is contemplated that the individual elements can be utilized in various combinations without departing from the scope of the invention.

Accordingly, the present invention is directed to a headbox of a paper machine that includes at least one material suspension supplying system, and a headbox nozzle that includes a first dividing wall having a machine width and a second dividing wall having a machine width, The first and second dividing walls are arranged to form a first path in which a total nozzle cross-section steadily and continually decreases in a material flow direction and to form a second path, arranged to follow the first path, in which a total nozzle cross-section continually increases in the material flow direction.

According to a feature of the instant invention, the first and second walls can be further arranged to form a third path in which a total nozzle cross-section steadily and continually decreases. The third path can be positioned to follow the second path. Further, a length L3 of the third path is shorter than a length L2 of the second path, and the length L2 is shorter than a length L1 of the first path. Moreover, the lengths L1, L2, and L3 conform to the following relationships:

$L2 \cdot 0.3 < L3 < L2 \cdot 0.7$; and $L1 \cdot 0.1 < L2 < L1 \cdot 0.3$.

In accordance with another feature of the instant invention, a turbulence producing region can be provided, and the first path may be arranged immediately after the turbulence producing region.

According to still another feature of the invention, the total cross-sectional area of at least one of the first path and the second path forms a single suspension conduit.

The headbox may also include at least one separating element, having a machine width, arranged between the first dividing wall and the second dividing wall. In this manner, a total cross-sectional area of at least one of the first path and the second path includes a plurality of suspension conduits formed by the at least one separating element, the first dividing wall, and the second dividing wall. Further, each of the plurality of suspension conduits within a same path can have a same cross-sectional progression. Additionally, or alternatively, each of the plurality of suspension conduits can have a congruent shape.

According to a further feature of the present invention, the at least one separating element can be located within a region of the second path, and a degree of divergence for each of the plurality of suspension conduits within the second path can be the same. Further still, the at least one separating element can have a pointed end which extends into a region of the second path. The at least one separating element can include a plurality of separating elements, and the pointed ends of each of the plurality of separating elements can include surfaces having a same degree of convergence. A progression of at least one of the upper wall and the lower wall in at least the second region can be symmetrical to a progression of a surface of the separating element adjacent one of the upper wall and the lower wall. A turbulence producer having a plurality of diffusion tubes can also be provided. The diffusion tubes may be arranged in rows extending cross-wise to the run direction, and the separating elements may be positioned between the rows of diffusion tubes.

According to still another feature of the invention, the upper wall and the lower wall may be equal in length.

In accordance with another feature of the present invention, a contraction ratio $\Delta H/\Delta L$ in a region of the first path can be between approximately 0.30/% and 40%, where the contraction ratio relates to ratio between a change in cross-section height, decreasing in the material flow direction of flow, to a path length. Preferably, the contraction ratio may be between approximately 10% and 30%.

According to still another feature of the invention, a divergence ratio $\Delta H/\Delta L$ in a region of the second path may be between approximately 0.1% and 20%, where the divergence ratio relates to a ratio between a change in cross-section height, increasing in the direction of flow, to a path length. Preferably, the divergence ratio may be between approximately 2% and 12%.

According to still another feature of the invention, a contraction ratio $\Delta H/\Delta L$ in a region of the third path is between approximately 1% and 400%, where the contraction ratio relates to a ratio between a change in cross-section height, decreasing in the direction of flow, to a path length. Preferably, the convergence ratio may be between approximately 10% and 200%.

Moreover, according to another feature of the present invention, the first path may be between approximately 250 mm and 1000 mm long, and preferably between approximately 400 mm and 800 mm long. The second path may be between approximately 20 mm and 150 mm long.

The first and second walls may be further arranged to form a third path in which a total nozzle cross-section steadily and continually decreases, and the third path may be positioned to follow the second path. The third path can be between approximately 0.5 mm and 300 mm long, and preferably between approximately 1 mm and 100 mm long.

According to a fiber feature of the instant invention, a smallest total cross-section height of the first path can be between approximately 10 mm and 500 mm, and preferably between approximately 15 mm and 150 mm.

In accordance with a further feature of the present invention, a greatest total cross-section height of the second path may be between approximately 30 mm to 600 mm.

According to a still further feature of the instant invention, the first and second walls may be Her arranged to form a third path in which a total nozzle cross-section steadily and continually decreases, and the third path may be positioned to follow the second path. A smallest total cross-section height of the third path can be between approximately 5 num and 80 mm.

In accordance with another feature of the invention, a region for producing turbulence can be provided. Further, the second path may be shorter than the first path, and second path can be arranged to directly follow the first path and to extend to an end of the headbox nozzle.

According to another feature of the instant invention, the first and second walls may be further arranged to form a third path in which a total nozzle cross-section steadily and continually decreases, and the third path may be positioned to follow the second path. The third path may be arranged to directly follow the second path and to extend to an end of the headbox nozzle, The present invention is also directed to a process of supplying a material suspension to an output of an apparatus including at least one material suspension supplying system and a headbox nozzle having a first dividing wall with a machine width and and a second dividing wall with a machine width. The process includes accelerating the material suspension along a first path having a total nozzle cross-section that steadily and continually decreases in a material flow direction, and decelerating the material suspension along a second path having a total nozzle cross-section that continually increases in the material flow direction. The second path is arranged to follow the first path.

According to a feature of the present invention, the process may further include accelerating the material suspension along a third path having a total nozzle cross-section that steadily and continually decreases, The third path may be arranged to follow the second path.

According to another feature of the instant invention, the process may further include creating turbulence in the material suspension before being accelerated in the first path.

In accordance with still another feature of the invention, the apparatus may further include a plurality of suspension conduits formed by at least one separating element, having a machine width, being arranged between the first dividing wall and the second dividing wall, and the process may further include at least one of (1) accelerating a plurality of portions of the material suspension through the plurality of suspension conduits in a region of the first path, and (2) decelerating a plurality of portions of the material suspension through the plurality of suspension conduits in a region of the second path. The apparatus can further include a turbulence producer having a plurality of diffusion tubes, and tie process may farther include each row of diffusion tubes producing turbulence in a respective suspension conduit adjacent thereto.

The present invention is also directed to a headbox of a paper machine that includes at least one material suspension supplying system, and a headbox nozzle including a first dividing wall having a machine width and and a second dividing wall having a machine width. The first and second dividing walls are arranged to form a first path in which a total nozzle cross-section steadily and continually decreases in a material flow direction and to form a second path, arranged to follow the first path, in which a total nozzle cross-section continually increases in the material flow direction. The second path directly follows the first path and is shorter than the first path.

According to a feature of the invention, the second path may extend from the first path to an end of the headbox nozzle.

In accordance with another feature of the instant invention, the first and second walls may be further arranged to form a third path in which a total nozzle cross-section steadily and continually decreases, and the third path may be positioned to directly follow the second path.

A turbulence producing region may also be included, and the first path may be arranged immediately after the turbulence producing region.

According to yet another feature of the invention, at least one separating element, having a machine width, may be arranged between the first dividing wall and the second dividing wall. A total cross-sectional area of at least one of the first path and the second path may include a plurality of suspension conduits formed by the at least one separating element, the first dividing wall, and the second dividing wall. The at least one separating element may continuously extend from a region of the first path to a region of the second path.

Other exemplary embodiments and advantages of the present invention may be ascertained by reviewing the present disclosure and the accompanying drawing.

DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
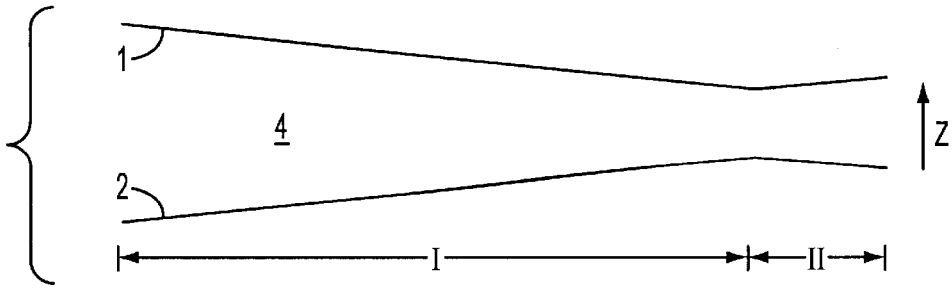
FIG. 1 illustrates a headbox nozzle without separating elements.
Figure 2:
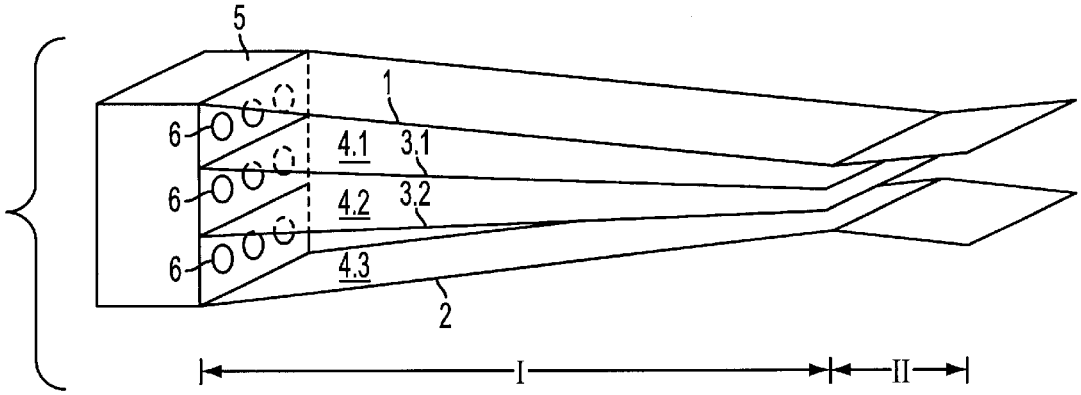
FIG. 2 illustrates a headbox nozzle with separating elements only in the converging region.

For the purpose of clarifying the idea of the invention, FIGS. 1–8 illustrate highly schematic lengthwise sections of a headbox nozzle in a machine direction following a turbulence producing region up to a discharge gap of the headbox. For clarifying the explanation of the invention, an exemplary arrangement of a turbulence producer 5 with a number of rows of diffusion tubes 6 coupled to headbox nozzle is depicted in FIG. 2, however, this illustration is likewise applicable to any of the other headbox nozzle arrangements disclosed in the instant application.

FIG. 1 illustrates an exemplary embodiment of a nozzle region of a headbox according to the instant invention in which a suspension conduit 4 is formed or defined between an upper wall 1 and an opposing lower wall 2. The headbox nozzle includes two paths I and II, each of which exhibit fundamentally different flow situations. As shown, path I has a total free cross-section for the material suspension flow that continually diminishes or decreases until an end of path I. As a result, an acceleration of the material suspension is caused in the flow direction. Following first path I is second path II in which a reversal of the acceleration, i.e., a flow deceleration, occurs such that die fibers in the material suspension in this region are oriented in the z direction due to the divergent form of the suspension conduit.

FIG. 2 illustrates an alternative headbox nozzle which includes upper wall 1 and lower wall 2 oriented with a progression that corresponds to that depicted in FIG. 1. Additionally, separating elements 3,1 and 3,2 can be inserted between upper wall 1 and lower wall 2. Separating elements 3.1 and 3.2 are also convergingly oriented or arranged in the flow direction so that three suspension conduits 4.1–4.3 are formed. Separately, each suspension conduit 4.1–4.3 converges over the length of path I and, together suspension conduits 4.1–4.3 have a convergence as a sum of the available cross-sections, i.e., total cross-section, along entire path I. Directly following path I is path II, which is free of separating elements, and which is formed by divergently running upper and lower walls 1 and 2. Thus, a deceleration of the material suspension flow is caused in second path II. It is important to note that regions of the headbox which cause deceleration of the material suspension are constructed so that no additional turbulences are caused by projections. Only in this way is an orientation of the fibers in the material suspension in the z direction achieved.

Figure 3:
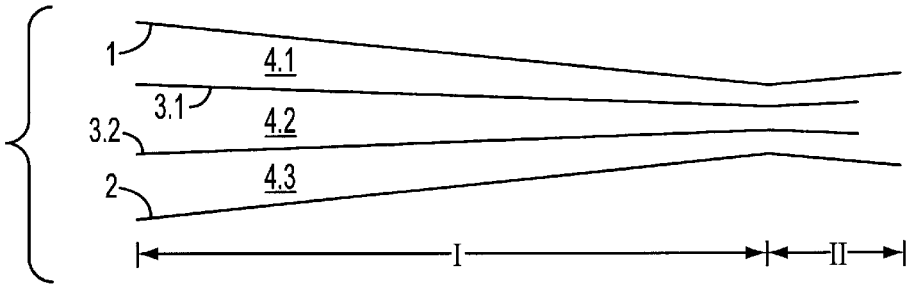
FIG. 3 illustrates a headbox nozzle with separating elements projecting into the diverging region.

FIG. 3 illustrates another exemplary embodiment of the headbox nozzle, which, while similar in general to the headbox depicted in FIG. 2, further includes separating elements 3.1 and 3.2 arranged to project into a region of second path II. Separating elements 3.1 and 3.2 can be constructed in a very flexible manner such that the lamella shape is adapted to the divergence of second path II and, due to the generally increasing cross-section in the downstream direction, a cross-sectional progression of the individual material suspension conduits 4.1 to 4.3 can be established, which also increases in the downstream direction Continuing separating elements 3.1 and 3.2 into the diverging region. i.e., path II, causes the orienting effect of the flow decelerating regions to be diminished because the available space in each suspension conduit is smaller and the fall height is only available in the end region of second path II.

Figure 4:
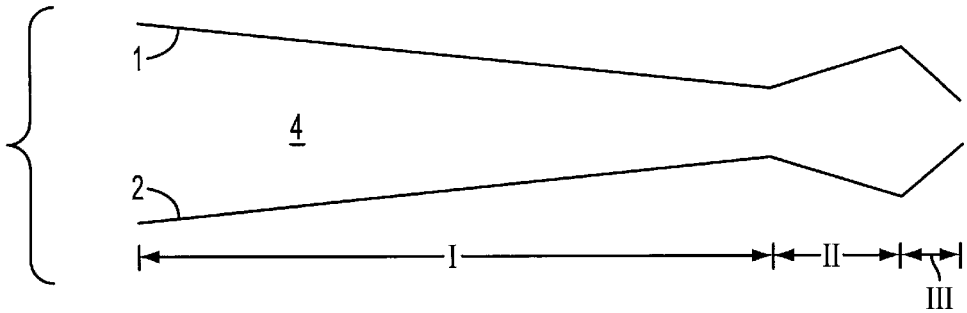
FIG. 4 illustrates a headbox nozzle without separating elements having a short diverging region and subsequent converging region.

FIG. 4 illustrates a continuation of the headbox nozzle depicted in FIG. 1, i.e., in which no separating elements are provided between upper and lower walls 1 and 2. It is noted that first and second paths I and II are oriented to correspond to the embodiment depicted in FIG. 1. A third path III is arranged as a short convergent stretch that is attached to the end of path II solely for the purpose ofjet stabilization. However, due to the essentially short period of effect, as compared with path II, path III does not completely compensate the original orienting of the fibers in the z direction from second path II.

Figure 5:
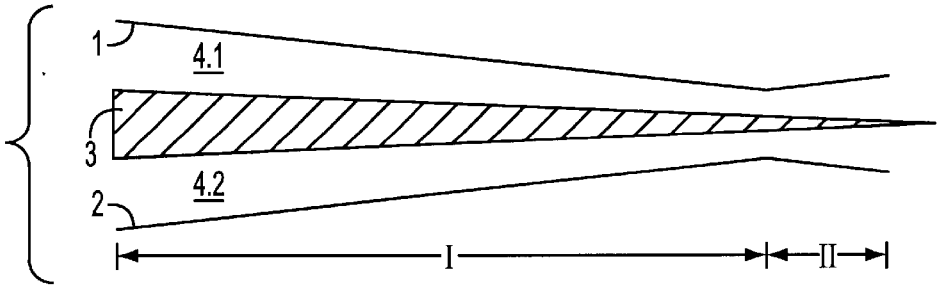
FIG. 5 illustrates a headbox nozzle with one separating element.

While separating elements are illustrated in FIGS. 2 and 3 as having thicknesses and, therefore, stabilities that are small, FIG. 5 illustrates a headbox nozzle that corresponds in general to the headbox nozzle depicted in FIG. 1 that also includes a relatively massive separating element (lamella) 3 arranged within the interior of the headbox nozzle. Separating element 3 has a thorough and even taper from the beginning of path I to the lamella end, which is arranged downstream of the nozzle outlet gap. The degree of tapering of separating element 3 can be selected such that a convergence between upper and lower walls 1 and 2 within fist path I is greater than a convergence of the surfaces of separating element 3. Further, the positioning of separating element 3 forms suspension conduits 4.1 and 4.2 between upper wall 1 and an upper surface of separating element 3 and between lower wall 2 and a lower surface of separating element 3, respectively, which are arranged to converge along the entire length of path I. Directly following path I is divergent path II, which is created by the divergently oriented upper and lower walls 1 and 2 in this section of the headbox nozzle.

However, it is also be possible for upper and lower walls 1 and 2 to be oriented to run parallel to one another within second path II, such that the divergence of the two suspension conduits and, thus, also the divergence of the total cross-section, is produced only by the tapering of separating lamella 3 within path II.

Figure 6:
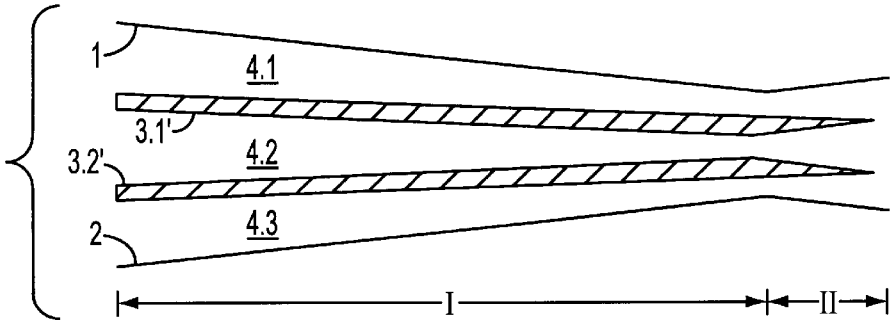
FIG. 6 illustrates a headbox nozzle with separating elements having increased end convergence.

FIG. 6 illustrates a headbox nozzle with upper and lower walls 1 and 2 which generally corresponds to the headbox nozzle depicted in FIG. 1, which also includes two large separating elements 3.1' and 3.2' arranged between upper and lower walls 1 and 2 to form three suspension conduits 4.1'–4.3'. Separating elements 3.1' and 3.2' can have a substantially same thickness over the entire region of first path I and can be convergently arranged as a whole. In this way, three suspension conduits 4.1'–4.3' are formed to converge along the entire length of first path I. In the directly subsequent area of second path II, the opposing surfaces of separating elements 3.1' and 3.2' can bend divergently from each other until coming to a point at the end of the outer surfaces, which are substantially flat along their entire extents through paths I and II.

Figure 7:
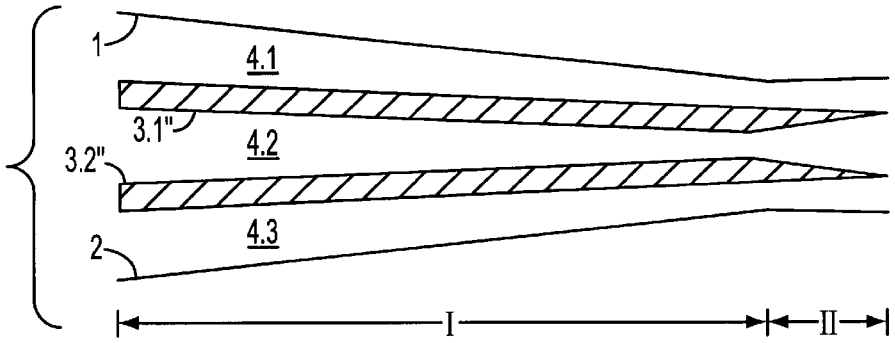
FIG. 7 illustrates a headbox nozzle with separating elements having increased end convergence and upper and lower walls running parallel to one another in the region of increased end convergence.

A similar embodiment of the headbox nozzle is illustrated in FIG. 7, in which both surfaces of separating elements 3.1" and 3.2" are tapered to a point within the progression of second path II. In second path II, upper and lower walls 1 and 2 of the headbox nozzle run can be oriented parallel to one another so that the divergence of material suspension conduits 4.1" to 4.3" is formed only by the taper of separating elements 3.1" and 3.2".

Figure 8:
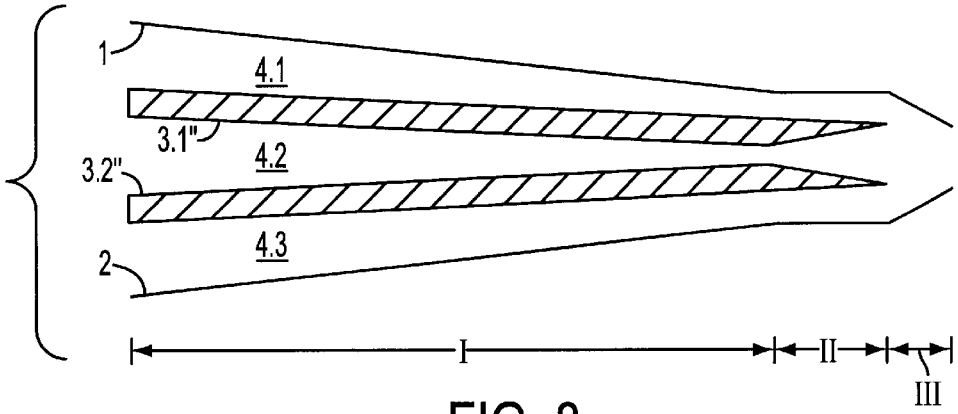
FIG. 8 illustrates a headbox nozzle with separating elements having increased end convergence and upper and lower walls running parallel to one another in the region of increased end convergence and subsequent strongly converging upper and lower walls.

FIG. 8 illustrates a headbox that corresponds in general to the headbox depicted in FIG. 7, which also includes additional path III coupled to the end of path II. Path III, in order to stabilize the open jet, provides a brief, intense constriction of the material suspension stream between upper and lower walls 1 and 2.

Figure 9:
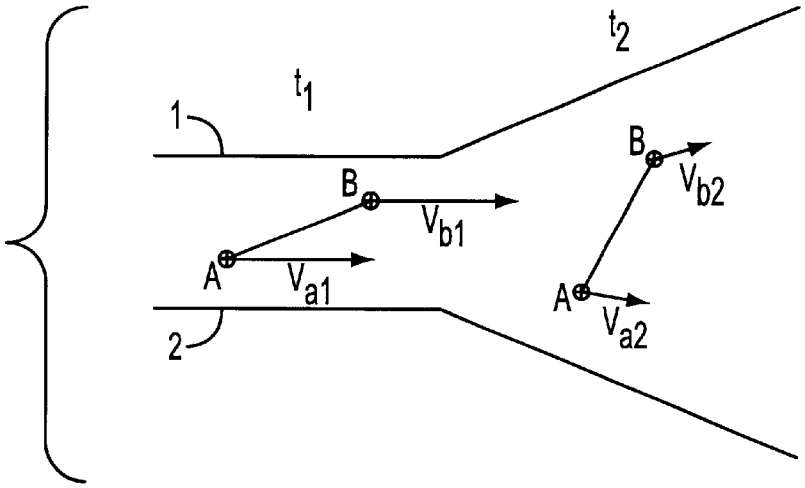
FIG. 9 illustrates fibers in the end region of a headbox nozzle with two instantaneous depictions.
Figure 10:
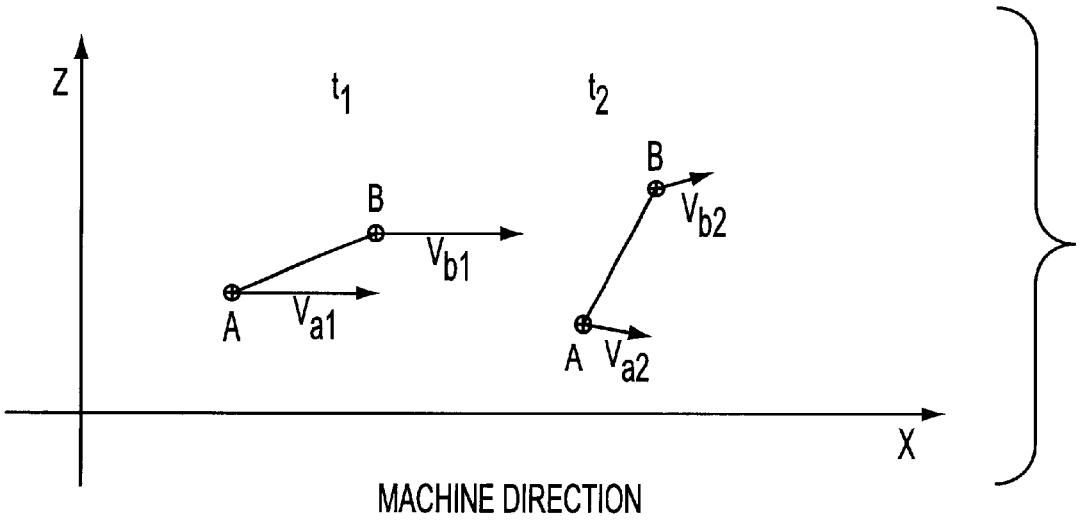
FIG. 10 illustrates the fibers in the end region of a headbox nozzle with two instantaneous depictions from FIG. 10 in the z-x coordinate grid.

FIGS. 9 and 10 illustrate the effect flow deceleration has on the orientation of a fiber F that extends between points A and B.

FIG. 9 illustrates two instantaneous depictions of fiber F at times $t_1$ and $t_2$, which relate to a transitioning from a continuous flow into a divergent, decelerated flow. At time $t_1$, endpoints A and B of fiber F have an even speed $V_{a1}$ and $V_{b1}$ whose speed vector has a forward component only. At time $t_2$, when the fiber is located in the diverging part of the flow, the flow has additional speed components in the z direction due to the divergent progression. Moreover, the speed of the fibers is greatly reduced in accordance with the continuity equalization caused by the larger available cross-section. The final effect of this is that points A and B approach one another in terms of their separation in the flow direction, while points A and B drift away from one another in the z direction. This type of movement causes a stretching and orientation of fiber F between points A and B in the z direction, which leads to an improvement in the cross-wise stiffness of the manufactured paper.

In FIG. 10, a same situation is shown on a coordinate graph with an x-axis and a z-axis in which each of the instantaneous depictions at the times $t_1$ and $t_2$ are shown.

It should be noted that, in the various exemplary embodiments shown, screens for setting an exit cross-section and, thus, for influencing the basis weight cross-direction profile that are known per se can be additionally provided on the downstream end of the upper and/or the lower wall without departing from the scope of the invention However, care should be taken that any disturbances caused by these screens only has a minor effect on he evenness of the flow.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

| | |
|---|---|
| 1 | Upper wall |
| 2 | Lower wall |
| 3 | Separating element |
| 3.1–3.2 | Separating element |
| 4 | Material suspension conduit |
| 4.1.–4.3 | Material suspension conduit |
| 5 | Turbulence producer |
| 6 | Diffusion tubes |
| F | Fiber |
| A,B | Endpoints |
| V | Speed vector |
| t | Time |

What is claimed is:

1. A headbox of a paper machine comprising:

at least one material suspension supplying system;

a headbox nozzle including a first dividing wall having a machine width and a second dividing wall having a machine width;

said first and second dividing walls being arranged to form a first path in which a total nozzle-cross-section steadily and continually decreases in a material flow direction and to form a second path, arranged to directly follow said first path, in which a total nozzle cross-section continually increases in the material flow direction;

a length L2 of said second flow path is shorter than a length L1 of the first flow path;

said first and second walls being farther arranged to form a third path in which a total nozzle cross-section steadily and continually decreases; and said third path being positioned to directly follow said second path, wherein a length L3 of said third path is shorter than the length of L2.

2. The headbox in accordance with claim 1, wherein said lengths L1, L2, and L3 conform to the following relationships:

$L2 \cdot 0.3 < L3 < L2 \cdot 0.7$; and $L1 \cdot 0.1 < L2 < L1 \cdot 0.3$.

3. The headbox in accordance with claim 1, further comprising a turbulence producing region; and said first path being arranged immediately after said turbulence producing region.

4. The headbox in accordance with claim 1, wherein the total cross-sectional area of at least one of said first path and said second path forms a single suspension conduit.

5. The headbox in accordance with claim 1, further comprising at least one separating element, having a machine width, being arranged between said first dividing wall and said second dividing wall, whereby a total cross-sectional area of at least one of said first path and said second path includes a plurality of suspension conduits formed by said at least one separating element, said first dividing wall, and said second dividing wall.

6. The headbox in accordance with claim 5, wherein each of the plurality of suspension conduits within a same path have a same cross-sectional progression.

7. The headbox in accordance with claim 5, wherein each of the plurality of suspension conduits have a congruent shape.

8. The headbox in accordance with claim 5, wherein said at least one separating element is located within a region of said second path, and wherein a degree of divergence for each of the plurality of suspension conduits within said second path is the same.

9. The headbox in accordance with claim 5, wherein said at least one separating element includes a pointed end which extends into a region of said second path.

10. The headbox in accordance with claim 9, wherein said at least one separating element comprises a plurality of separating elements, and wherein the pointed ends of each of said plurality of separating elements comprises surfaces having a same degree of convergence.

11. The headbox in accordance with claim 5, wherein a progression of at least one of said upper wall and said lower wall in at least said second region is symmetrical to a progression of a surface of said separating element adjacent one of said upper wall and said lower wall.

12. The headbox in accordance with claim 5, further comprising a turbulence producer having a plurality of diffusion tubes, wherein said diffusion tubes are arranged in rows extending cross-wise to the run direction, and wherein said separating elements are positioned between said rows of diffusion tubes.

13. The headbox in accordance with claim 1, wherein said upper wall and said lower wall are equal in length.

14. The headbox in accordance with claim 1, wherein a contraction ratio $\Delta H/\Delta L$ in a region of said first path is between approximately 0.3% and 40%, and wherein the contraction ratio is a ratio between a change in cross-section height, decreasing in the material flow direction of flow, and a path length.

15. The headbox in accordance with claim 14, wherein the contraction ratio is between approximately 10% and 30%.

16. The headbox in accordance with claim 1, wherein a divergence ratio $\Delta H/\Delta L$ in a region of said second path is between approximately 0.1% and 20%, and wherein the divergence ratio is a ratio between a change in cross-section height, increasing in the direction of flow, and a path length.

17. The headbox in accordance with claim 16, wherein the divergence ratio is between approximately 2% and 12%.

18. The headbox in accordance with claim 1, wherein a contraction ratio $\Delta H/\Delta L$ in a region of said third path is between approximately 1% and 400%, and wherein the contraction ratio is a ratio between a change in cross-section height, decreasing in the direction of flow, and a path length.

19. The headbox in accordance with claim 18, wherein the convergence ratio is between approximately 10% and 200%.

20. The headbox in accordance with claim 1, wherein the length L1 is between approximately 250 mm and 1000 mm long.

21. The headbox in accordance with claim 1, wherein the length L1 is between approximately 400 mm and 800 mm long.

22. The headbox in accordance with claim 1, wherein the length L2 is between approximately 20 mm and 150 mm long.

23. The headbox in accordance with claim 1, said first and second walls being further arranged to form a third path in which a total nozzle cross-section steadily and continually decreases; and said third path being positioned to follow said second path, wherein said third path is between approximately 0.5 mm and 300 mm long.

24. The headbox in accordance with claim 23, wherein said third path is between approximately 1 mm and 100 mm long.

25. The headbox in accordance with claim 1, wherein a smallest total cross-section, height of said first path is between approximately 10 mm and 500 mm.

26. The headbox in accordance with claim 25, wherein a smallest total cross-section height of said first path is between approximately 15 mm and 150 mm.

27. The headbox in accordance with claim 1, wherein a greatest total cross-section height of the second path is between approximately 30 mm to 600 mm.

28. The headbox in accordance with claim 1, said first and second walls being further arranged to form a third path in which a total nozzle cross-section steadily and continually decreases; and said third path being positioned to follow said second path, wherein a smallest total cross-section height of said third path is between approximately 5 mm and 80 mm.

29. The headbox in accordance with claim 1, said first and second walls being further arranged to form a third path in which a total nozzle cross-section steadily and continually decreases; and said third path being positioned to follow said second path, wherein said third path is arranged to directly follow said second path and to extend to an end of said headbox nozzle.

30. A headbox of a paper machine comprising:

at least one material suspension supplying system;

a headbox nozzle including a first dividing wall having a machine width and a second dividing wall having a machine width;

said first and second dividing walls being arranged to form a first path in which a total nozzle cross-section steadily and continually decreases in a material flow direction and to form a second path, arranged to follow said first path, in which a total nozzle cross-section continually increases in the material flow direction; and a region for producing turbulence, wherein said second path is shorter than said first path, and second path is arranged to directly follow said first path and to extend to an end of said headbox nozzle.

31. A process of supplying a material suspension to an output of an apparatus including at least one material suspension supplying system and a headbox nozzle having a first dividing wall with a machine width and a second dividing wall with a machine width, said process comprising:

accelerating the material suspension along a first path having a total nozzle cross-section that steadily and continually decreases in a material flow direction;

decelerating the material suspension along a second path having a total nozzle cross-section that continually increases in the material flow direction; and accelerating the material suspension along a third path having a total nozzle cross-section that steadily and continually decreases in the material flow direction, wherein said second path is arranged to directly follow said first path and is shorter than said first path, and wherein said third path is arranged to directly follow said second path and is shorter than said second path.

32. The process in accordance with claim 31, further comprising:

creating turbulence in the material suspension before being accelerated in the first path.

33. The process in accordance with claim 31, wherein the apparatus further includes a plurality of suspension conduits formed by at least one separating element, having a machine width, being arranged between said first dividing wall and said second dividing wall, and said process further comprises at least one of:

(1) accelerating a plurality of portions of said material suspension through the plurality of suspension conduits in a region of the fist path; and (2) decelerating a plurality of portion of the material suspension though the plurality of suspension conduits in a region of the second path.

34. The process in accordance with claim 33, the apparatus further including a turbulence producer having a plurality of diffusion tubes, and the process further comprises:

each row of diffusion tubes producing turbulence in a respective suspension conduit adjacent thereto.

35. A headbox of a paper machine comprising:

at least one material suspension supplying system;

a headbox nozzle including a first dividing wall having a machine width and a second dividing wall having a machine width;

said first and second dividing walls being arranged to form a first path in which a total nozzle cross-section steadily and continually decreases in a material flow direction and to form a second path, arranged to follow said first path, in which a total nozzle cross-section continually increases in the material flow direction, wherein said second path directly follows said first path and is shorter than said first path; and said second path extending from said first path to an end of said headbox nozzle.

36. The headbox in accordance with claim 35, further comprising a turbulence producing region; and said first path being arranged immediately after said turbulence producing region.

37. The headbox in accordance with claim 35, further comprising at least one separating element, having a machine width, being arranged between said first dividing wall and said second dividing wall, whereby a total cross-sectional area of at least one of said first path and said second path includes a plurality of suspension conduits formed by said at least one separating element, said first dividing wall, and said second dividing wall.

38. The headbox in accordance with claim 37, wherein said at least one separating element continuously extends from a region of said first path to a region of said second path.

* * * * *